United States Patent [19]

Ichiki

[11] Patent Number: 4,785,703

[45] Date of Patent: Nov. 22, 1988

[54] POLYTONAL AUTOMATIC ACCOMPANIMENT APPARATUS

[75] Inventor: Tetsuji Ichiki, Hamamatsu, Japan

[73] Assignee: Nippon Gakki Seizo Kabushiki Kaisha, Hamamatsu, Japan

[21] Appl. No.: 29,605

[22] Filed: Mar. 24, 1987

[30] Foreign Application Priority Data

Mar. 25, 1986 [JP] Japan ..... 61-66799

[51] Int. Cl.[4] ..... G10F 1/00

[52] U.S. Cl. ..... 84/1.03; 84/1.28; 84/DIG. 12

[58] Field of Search ..... 84/1.03, 1.28, DIG. 12

[56] References Cited

U.S. PATENT DOCUMENTS

| | | | |
|---|---|---|---|
| 4,326,441 | 4/1982 | Imamura et al. | 84/1.03 |
| 4,667,556 | 5/1987 | Hanzawa et al. | 84/1.28 |
| 4,681,008 | 7/1987 | Morikawa et al. | 84/1.28 |
| 4,696,214 | 9/1987 | Ichiki | 84/1.28 |

FOREIGN PATENT DOCUMENTS

| | | |
|---|---|---|
| 59-166291 | 11/1984 | Japan . |
| 60-145497 | 9/1985 | Japan . |

*Primary Examiner*—Patrick R. Salce
*Assistant Examiner*—Jeffrey Sterrett
*Attorney, Agent, or Firm*—Blakely, Sokoloff, Taylor & Zafman

[57] ABSTRACT

An automatic accompaniment apparatus includes an accompaniment pattern generation unit for generating a plurality of accompaniment patterns which represent timing of generation of a plurality of accompaniment tones to be generated respectively. The accompaniment patterns correspond to accompaniment tones. The apparatus also includes a tone input unit for inputting the accompaniment tones to be generated and for changing the accompaniment tones into a plurality of tone date respectively, a first memory, second memory having a plurality of storage locations corresponding to the accompaniment patterns respectively, a writing unit for writing sequentially the tone data in the first memory and for writing a plurality of area information identifying respectively storage areas of the first memory in which the tone data are stored, into corresponding ones of the storage locations, and a reading out unit for reading out the area information from the storage locations corresponding to the accompaniment patterns and for reading out the tone data from the storage area identified by the area information read out. The accompaniment tones can be produced in accordance with the tone data read out.

7 Claims, 5 Drawing Sheets

POLYTONAL AUTOMATIC ACCOMPANIMENT APPARATUS

BACKGROUND OF THE INVENTION

The present invention relates to an automatic accompaniment apparatus, such as an auto-rhythm machine, auto-bass machine, and the like and, more particularly, to an automatic accompaniment apparatus for receiving a plurality of arbitrary tones and generating musical tones in accordance with an accompaniment pattern.

In a known conventional auto-rhythm apparatus, a waveshape of a tone signal input therein through, e.g., a microphone, is stored in a RAM (Random Access Memory), and the input tone waveshape is read out from the RAM in accordance with a rhythm pattern, thereby generating a rhythm tone (e.g., Japanese Utility Model Laid-Open No. 60-145497).

With the conventional apparatus, however, a waveshape for only one tone can be stored in the RAM. Therefore, the rhythm performance becomes monotonous.

In order to provide various rhythm performance modes, a plurality of input tone waveshapes have to be stored. As a method to do it, it can be considered that a plurality of RAMs are arranged, or an address of a single RAM is divided to determine a plurality of memory areas which can be independently accessed, and that, thus, different input tone waveshapes are stored in each RAM or in each memory area.

However, with this arrangement, each RAM or memory area must have a capacity capable of storing a waveshape corresponding to a maximum data volume among input tone waveshapes. Therefore, the total memory capacity of a waveshape memory is increased, and for a waveshape having a small data volume, the corresponding memory space becomes nonusable.

SUMMARY OF THE INVENTION

It is, therefore, a principle object of the present invention to provide an automatic accompaniment apparatus which can realize various accompaniment tone modes.

It is another object of the present invention to provide an automatic accompaniment apparatus which can eliminate a nonusable memory space, and needs only a small memory capacity.

In order to achieve the above objects, there is provided an automatic accompaniment apparatus, comprising: accompaniment pattern generation means for generating a plurality of accompaniment patterns which represent timing of generation of a plurality of accompaniment tones to be generated respectively, the accompaniment patterns corresponding to the accompaniment tones; tone input means for inputting the accompaniment tones to be generated and for changing the accompaniment tones into a plurality of tone date respectively; first memory means; second memory means having a plurality of storage locations corresponding to the accompaniment patterns respectively; writing means for writing sequentially the tone data in the first memory means and for writing a plurality of area information identifying respectively storage areas of the first memory means in which the tone data are stored, into corresponding ones of the storage locations; and reading out means for reading out the area information from the storage locations corresponding to the accompaniment patterns and for reading out the tone data from the storage area identified by the area information read out whereby accompaniment tones can be produced in accordance with the tone data read out.

DETAILED DESCRIPTION OF THE PREFERRED EMBODIMENTS

Figure 1:
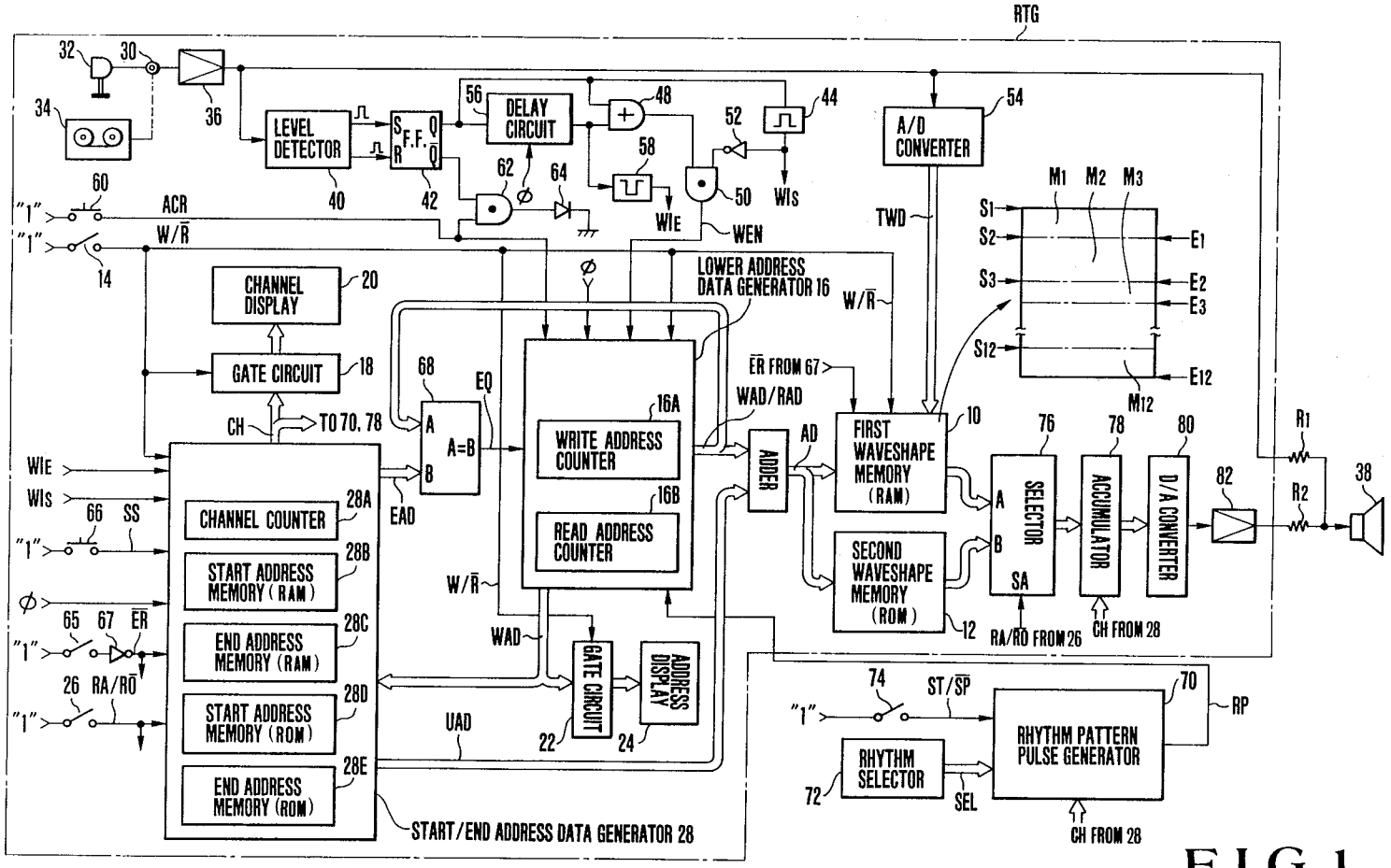
FIG. 1 is a block diagram showing a circuit arrangement of an auto-rhythm apparatus according to an embodiment of the present invention.

FIG. 1 shows an auto-rhythm apparatus according to an embodiment of the present invention. The auto-rhythm apparatus has a rhythm tone generator RTG having time-divisional 12 tone generation channels. More specifically, the rhythm tone generator RTG includes a first waveshape memory 10 comprising a RAM to which waveshape data for 12 tones can be written, and a second waveshape memory 12 comprising a ROM (Read-Only Memory) in which waveshape data for 12 tones have been factory-set in advance. The waveshape data is read out from either of the waveshape memories (10 or 12) in a time-divisional manner in accordance with a selected rhythm, thereby achieving an auto-rhythm performance.

Waveshape Data Write Access to First Waveshape Memory 10 (FIG. 1)

In the circuit shown in FIG. 1, when waveshape data is written in the first waveshape memory 10, a write/-read control switch 14 is turned on. Then, a write/read control signal $W/\overline{R}$ goes to logic level "1", and the first waveshape memory 10 and a lower address data generator 16 are set in a write mode. In this case, since a gate circuit 18 is enabled, a channel number is displayed on a channel display 20 in accordance with channel number data CH. In addition, since a gate circuit 22 is enabled, a lower address is displayed on an address display 24 in accordance with write lower address data WAD.

Upon write access of waveshape data, a RAM/ROM switch 26 is set in an ON state in advance. A memory selection signal $RA/\overline{RO}$ goes to logic level "1", and a start address memory 28B comprising a RAM in a start-/end address data generator 28 is enabled.

An input terminal 30 is connected to a microphone 32 or an external machine 34 such as a tape recorder, so as to input an arbitrary tone signal (e.g., a percussive tone signal, a human or animal voice signal, and the like). Assuming that a desired tone signal is input, the input tone signal is supplied to a loudspeaker 38 through an input amplifier 36 and a resistor $R_1$ to generate a corresponding tone, and is also supplied to a level detector 40 through the input amplifier 36.

The level detector 40 sets an R-S flip-flop 42 substantially in synchronism with the leading edge of the input signal. For this reason, an output Q from the flip-flop 42 goes to logic level "1". In response to this, a write instruction pulse $WI_S$ for a start address is sent out from a rise differentiator 44, and is supplied to the start/end address data generator 28.

In the start/end address data generator 28, when the write/read control signal $W/\overline{R}$ goes to logic level "1", a channel counter 28A consisting of a duodecimal counter is reset. The channel counter generates channel number data CH representing a channel number "0", and the channel display 20 displays the channel number "0" accordingly. In the generator 28, start address data indicating a start address "0" of a first tone is stored in a memory area corresponding to the channel number "0" of the start address memory 28B in accordance with the write instruction pulse $WI_S$. The start address data is read out immediately after it is written, and is supplied to an adder 46 as upper address data UAD.

When the output Q from the flip-flop 42 goes to logic level "1", the output from an OR gate 48 goes to logic level "1", and the "1" output is supplied to an AND gate 50. The AND gate 50 also receives the write instruction pulse $WI_S$ through an inverter 52. For this reason, the output from the AND gate 50 goes to logic level "1" to be delayed by an interval corresponding to the pulse width of the write instruction pulse $WI_S$ after the output Q from the flip-flop 42 goes to logic level "1". The "1" output from the AND gate 50 is supplied to the lower address data generator 16 as a write enable signal WEN.

The lower address data generator 16 has a write address counter 16A. The counter 16A counts a clock signal $\phi$ when the write enable signal WEN goes to logic level "1", so as to generate write lower address data WAD, and the address display 24 displays the lower address accordingly. The lower address data WAD is supplied to the adder 46, and is added to the upper address data UAD. The sum output from the adder 46 is supplied to the first waveshape memory 10 as address data AD.

An A/D (analog-to-digital) converter 54 A/D converts an input tone signal from the input amplifier 36 for each sample point, and supplies digital waveshape data TWD representing an amplitude to the first waveshape memory 10 for each sample point.

In the first waveshape memory 10, a memory area $M_1$ corresponding to the channel number "0" is designated in accordance with the address data AD, and the waveshape data TWD for the first tone is written in the area $M_1$. In this case, a start address $S_1$ of the memory area $M_1$ is "0", as described above, and an end address $E_1$ is determined as follows.

More specifically, when the level detector 40 resets the flip-flop 42 substantially in synchronism with completion of decay of the first tone, the output Q from the flip-flop 42 goes to logic level "0", and an output $\overline{Q}$ goes to logic level "1". A delay circuit 56 is adopted to delay the output Q from the flip-flop 42 by several periods of the clock signal $\phi$. When the output Q from the flip-flop 42 goes to logic level "0", the output from the delay circuit 56 goes to logic level "0" to be delayed therefrom by the several periods, and the write enable signal WEN also goes to "0" in response to this. For this reason, in the lower address data generator 16, the write address counter 16A stops counting of the clock signal $\phi$, and the count value at this time is used as the end address $E_1$. In this manner, when the end address is determined to be slightly delayed from the completion of decay of the first tone, the memory area $M_1$ for the first tone can have a certain margin. Note that the end address $E_1$ can be confirmed using the address display 24.

The rise differentiator 58 synchronously generates a write instruction pulse $WI_E$ when the output from the delay circuit 56 goes from logic level "1" to "0", and supplies it to the start/end address data generator 28. In the generator 28, end address data indicating the end address $E_1$ is written in a memory area corresponding to the channel number "0" of an end address memory 28C comprising a RAM. The written end address data is used for stop-controlling waveshape data read access from the first waveshape memory 10.

After waveshape data write access for the first tone is completed as described above, a counter reset switch 60 is turned on. In response to this, a counter reset signal ACR goes to logic level "1", and the write address counter 16A in the lower address data generator 16 is reset to a count value "0". The output from an AND gate 62, which receives the output $\overline{Q}$="1", goes to logic level "1" in accordance with the counter reset signal ACR="1", and a light-emitting diode 64 is turned on accordingly. The ON state of the light-emitting diode 64 indicates that waveshape data write access for a second tone is allowed.

Thereafter, when a step switch 66 is turned on once to generate a step signal SS, the count value of the channel counter 28A in the generator 28 is incremented by one. More specifically, channel number data CH representing a channel number "1" is generated from the channel counter, and the channel display 20 displays the channel number "1" accordingly.

Assuming that a second tone signal is input through the input terminal 30, the write instruction pulse $WI_S$ is generated in the same manner as described above, and in the generator 28, the start address data for the second tone is written in a memory area corresponding to the channel number "1" of the start address memory 28B. The start address data for the second tone represents a start address $S_2$ obtained by adding 1 to the end address $E_1$ of the first tone. The start address data for the second tone is supplied to the adder 46 as the upper address data UAD.

The AND gate 50 generates the write enable signal WEN in the same manner as described above, and the write address counter in the generator 16 supplies the write lower address data WAD to the adder 46 in response to this. Therefore, waveshape data TWD for the second tone is written in a memory area $M_2$ corresponding to the channel number "1" of the first waveshape memory 10 in accordance with the address data AD from the adder 46 in the same manner as described above.

When the output from the AND gate 50 goes from logic level "1" to "0" to be slightly delayed from the completion of decay of the second input tone, the write address counter 16A in the generator 16 stops counting in the same manner as described above, and the count value at the time is used as an end address $E_2$ for the second tone. The rise differentiator 58 generates the write instruction pulse $WI_E$, and in the generator 28, end address data indicating the end address $E_2$ is written in a memory area corresponding to the channel number "1" of the end address memory 28C accordingly.

Thereafter, the above-mentioned processing is repeated such that after the counter reset switch 60 is turned on, the channel number is incremented by one by the step switch 66, and a desired tone signal is input. In this manner, waveshape data for a maximum of 12 tones can be written in the first waveshape memory 10, and 12 rhythm tone generators can be assigned to 12 tone generation channels. With this sequential write method, the number of addresses of the memory areas $M_1$ to $M_{12}$ is determined in accordance with a waveshape data volume of the corresponding input tone, and cannot become constant as long as different tones are input.

When waveshape data written in the first waveshape memory 10 is to be erased, an erase switch 65 is turned on. In response to this, an erase instruction signal $\overline{ER}$ as an output from an inverter 67 connected to the erase switch 65 goes to logic level "0", and the waveshape data in the first waveshape memory 10 is erased. In addition, the address data in the start address memory 28B and the end address memory 28C are erased.

Auto-Rhythm Performance Based on Storage Data (FIG. 1)

Upon auto-rhythm performance, storage data in either of the first or second waveshape memory 10 or 12 is used.

A case will be described wherein storage data in the first waveshape memory 10 is used. In this case, when the write/read control switch 14 is turned off, the write/read control signal $W/\overline{R}$ goes to logic level "0", and the first waveshape memory 10 and the lower address data generator 16 are set in a read mode. Since the gate circuits 18 and 22 are disabled, the channel display 20 and the address display 24 do not perform a display operation.

In the start/end address data generator 28, when the write/read control signal $W/\overline{R}$ goes to logic level "0", the channel counter 28A counts the clock signal $\phi$, and generates the channel number data CH. Since the channel counter 28A comprises the duodecimal counter, data representing channel numbers "0" to "11" are sequentially and repetitively sent as the channel number data CH.

When the first waveshape memory 10 is used, since the RAM/ROM switch 26 is turned on in advance, the start address memory 28B and the end address memory 28C each comprising the RAMs in the generator 28 can be used. Start address data for 12 channels (12 tones) are sequentially read out from the start address memory 28B in accordance with the channel number data, and are supplied to the adder 46 as the upper address data UAD. End address data for 12 channels are sequentially read out from the end address memory 28C in accordance with the channel number data CH, and each end address data EAD is supplied to a comparator 68 as a comparison input B.

A rhythm pattern pulse generator 70 includes a rhythm pattern memory in which a large number of rhythm patterns corresponding to a large number of types of rhythm, such as "march", "waltz", "swing", and the like, are factory-set. A rhythm pattern read out from the rhythm pattern memory can be designated by rhythm selection data SEL from a rhythm selector 72.

A rhythm pattern corresponding to each type of rhythm consists of pattern data for one measure corresponding to count values "0" to "95" of tempo clock pulses. The pattern data corresponding to each count value represents a channel to be subjected to tone generation of the 12 tone generation channels at a tone generation timing corresponding to the count value.

When a rhythm start/stop switch 74 is turned on, a start/stop control signal $ST/\overline{SP}$ goes to logic level "1", and the rhythm pattern generator 70 sends out rhythm pattern pulses RP in a time-divisional manner in accordance with a rhythm pattern corresponding to the selected type of rhythm. More specifically, each rhythm pattern pulse is supplied to the lower address data generator 16 in a time slot corresponding to a channel to be subjected to tone generation of 12 time slots in accordance with the channel number data CH, and is used as a tone generation instruction signal for each channel.

The lower address data generator 16 has a read address counter 16B which can count the clock signal $\phi$ in a time-divisional manner. The counter 16B counts the clock signal $\phi$ at the timing corresponding to a channel to be subjected to tone generation according to the rhythm pattern pulse, and supplies its count output to the adder 46 as lower address data RAD. The lower address data RAD is also supplied to the comparator 68 as a comparison input A.

The adder 46 adds the start address data as the upper address data UAD and the read lower address data RAD, and supplies the sum output to the first waveshape memory 10 as the address data AD. As a result, waveshape data can be time-divisionally read out from the first waveshape memory 10 in accordance with the address data AD. For example, when the rhythm pattern RP is generated so as to instruct tone generation at channels of the channels numbers "0" and "2" in association with a given tone generation timing, waveshape data stored in the memory areas $M_1$ and $M_3$ are time-divisionally read out from the first waveshape memory 10. When the read access of the waveshape data is completed for each memory area, the comparator 68 generates an equal signal EQ upon detecting coincidence between the comparison inputs A and B. In response to this, a count value corresponding to the channel of the read address counter 16B associated with the coincidence is reset to "0".

A selector 76 can select the input A since the memory selection signal $RA/\overline{RO}$ is at logic level "1". For this reason, the waveshape data read out from the first waveshape memory 10 is supplied to an accumulator 78 through the selector 76.

The accumulator 78 accumulates readout data for a plurality of channels based on the channel number data CH and outputs waveshape data representing a composite waveform. The output data from the accumulator 78 is converted to an analog signal by a D/A (digital-to-analog) converter 80. The analog signal from the D/A converter 80 is supplied to the loudspeaker 38 through an output amplifier 82 and a resistor $R_2$, and is converted to an acoustic sound.

As described above, when waveshape data is time-divisionally read out from the first waveshape memory 10 in accordance with the selected rhythm pattern, an auto-rhythm performance can be performed. In this case, when the waveshape data stored in the first waveshape memory 10 is rewritten, an arbitrary rhythm tone generator group can be set. Therefore, various rhythm performance modes can be enjoyed.

When the auto-rhythm performance is to be stopped, the rhythm start/stop switch 74 can be turned off.

A case will be described wherein storage data in the second waveshape memory 12 is used. In this case, the write/read control switch 74 is turned off in the same manner as described above. In addition, the RAM/ROM switch 26 is also turned off. In response to this, the memory selection signal $RA/\overline{RO}$ goes to logic level "0", and a start address memory 28D and an end address memory 28E in the generator 28 are enabled. In response to the memory selection signal RA/$\overline{RO}$="0", the selector 76 is allowed to select the input B as the readout data from the second waveshape memory 12.

Thereafter, when the rhythm start/stop switch 74 is turned on, the auto-rhythm performance can be made by the same time-divisional readout operation as described above, except that the memories 12, 28D, and 28E are used instead of the memories 10, 28B and 28C.

Figure 2:
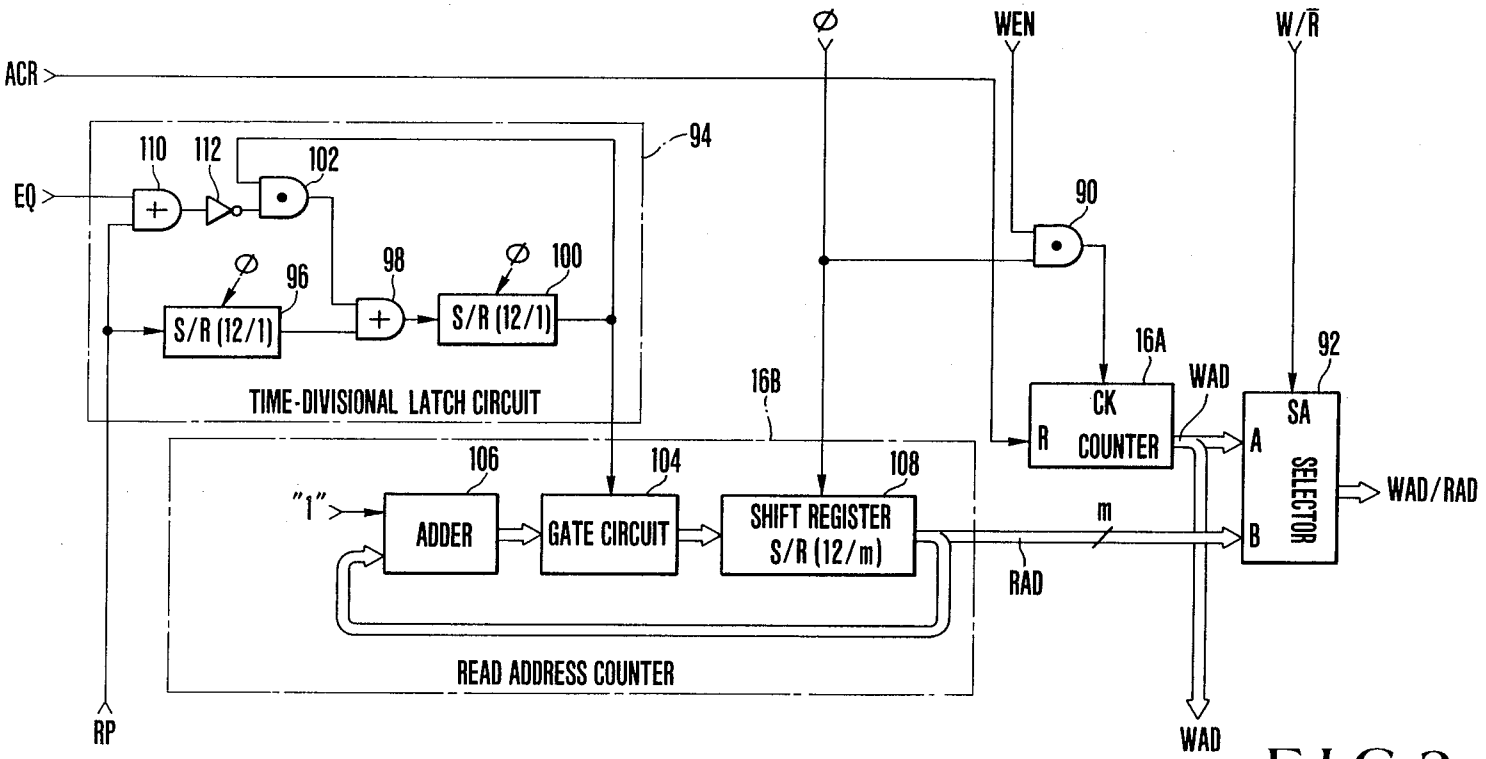
FIG. 2 is a circuit diagram showing an arrangement of a lower address, data generator shown in FIG. 1.

Lower Address Data Generator (FIG. 2)

FIG. 2 shows the arrangement of the lower address data generator 16.

In the write mode, an AND gate 90 is enabled in response to the write enable signal WEN="1", and supplies the clock signal $\phi$ to the write address counter 16A. The counter 16A counts the clock signal $\phi$, and supplies the write lower address data WAD as its count output to the selector 92 as the input A. The counter 16A also supplies the data WAD to the start/end address data generator 28 and the gate circuit 22, as shown in FIG. 1.

The selector 92 selects the input A in the write mode in which the write/read control signal W/$\overline{R}$ is at logic level "1". For this reason, the write lower address data WAD from the counter 16A is supplied to the adder 46 shown in FIG. 1 through the selector 92.

When the write enable signal WEN goes to logic level "0" after decay of the input tone is ended, the AND gate 90 is disabled and the counter 16A stops counting.

The counter 16A is reset in response to the counter reset signal ACR.

In the read mode, a time-divisional latch circuit 94 and the read address counter 16B can be used. The rhythm pattern RP is input to a 12-stage/1-bit shift register (S/R) 96 which is operated in response to the clock signal $\phi$. The rhythm pattern pulse RP output from the shift register 96 is input to a 12-stage/1-bit shift register (S/R) 100 through an OR gate 98, and is shifted in accordance with the clock signal $\phi$. The rhythm pattern pulse sent out from the shift register 100 is input again to the shift register 100 through an AND gate 102 and the OR gate 98, and thereafter, is cyclically stored in this closed loop.

The rhythm pattern pulse sent out from the shift register 100 is also supplied to a gate circuit 104. The gate circuit 104 is arranged along a data path extending from an adder 106 to a 12-stage/m-bit (m corresponds to the number of bits of the counter 16A) shift register (S/R) 108. The adder 106 adds "1" to the least significant bit of the output data from the shift register 108 and outputs it. The shift register 108 performs a shift operation in response to the clock signal $\phi$. Therefore, the gate circuit 104, the adder 106, and the shift register 108 constitute a time-divisional counter which is operated synchronously with the shift registers 96 and 100.

For example, when the shift register 100 sends out the rhythm pattern pulse at every timing of a 0th channel, the time-divisional counter is incremented by one at every timing corresponding to the 0th channel. This also applies to timings for first to 11th channels. In the counter 16B, the time-divisional count operation for 12 channels can be performed in this manner.

The count output from the counter 16B is sent out as the read lower address data RAD, and is input to the selector 92 as the input B. The selector 92 is allowed to select the input B in the read mode in response to the write/read control signal W/$\overline{R}$="0". Therefore, the read lower address RAD is supplied to the adder 46 and the comparator 68 shown in FIG. 1 through the selector 92.

When the equal signal EQ is output from the comparator 68 upon completion of read access of waveshape data for one tone, the equal signal is supplied to an inverter 112 through an OR gate 110. The AND gate 102 is disabled since the output from the inverter 112 is at logic level "0", and the rhythm pattern pulse which is cyclically stored is erased. Therefore, the gate circuit 104 is disabled at a timing of a channel associated with a detected coincidence, and the count value corresponding to the channel is reset to "0".

If the rhythm pattern pulse RP of the same channel as that of the rhythm pattern pulse which is cyclically stored arrives before the equal signal EQ is generated, the rhythm pattern pulse disables the AND gate 102 through the OR gate 110 and the inverter 112. Therefore, the count value of the counter 16B is reset in the same manner as in the case of the equal signal EQ. The rhythm pattern pulse at this time is input to the shift register 100 through the shift register 96 and the OR gate 98, and is cyclically stored in the same manner as described above. The counter 16B starts counting for the reset channel. As a result, during read access of waveshape data for one tone, when a rhythm pattern pulse is generated for the same tone, the waveshape data can be read out from the start address.

Figure 3:
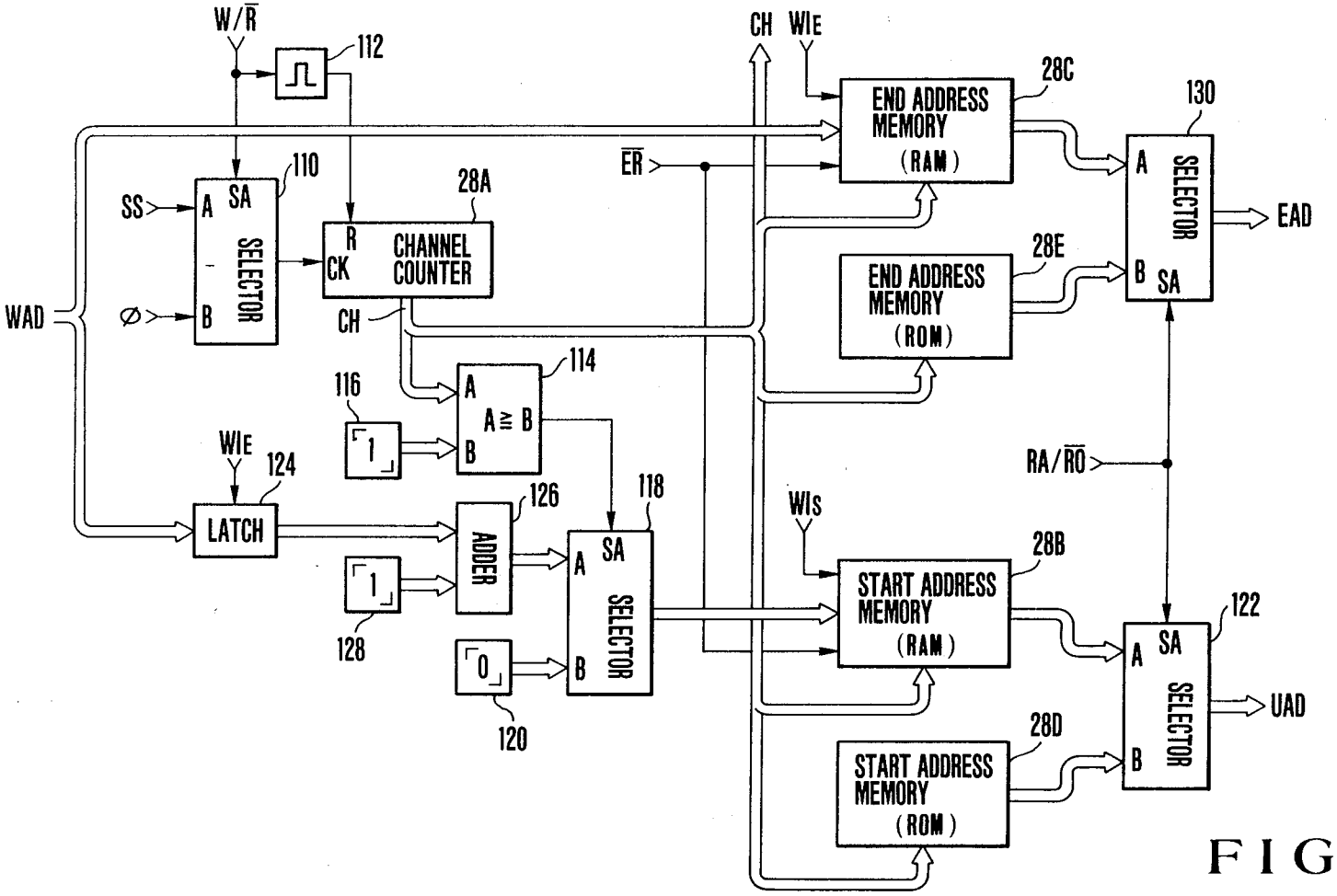
FIG. 3 is a circuit diagram showing an arrangement of a start/end address data generator shown in FIG. 1.

Start/End Address Data Generator (FIG. 3)

FIG. 3 shows the arrangement of the start/end address generator 28.

In the write mode, a selector 110 selects the step signal SS from the step switch 66 shown in FIG. 1 in response to the write/read control signal W/$\overline{R}$="1" and to supply it to the channel counter 28B.

When the write/read control signal W/$\overline{R}$ goes to logic level "1", the channel counter 28B is reset in accordance with the output from a rise differentiator 112 which receives the signal W/$\overline{R}$. The channel number data CH representing the count value (channel number) "0" at this time is supplied to the gate circuit 18 shown in FIG. 1, and is also supplied to a comparator 114 as an input A. Data representing a numerical value "1" is input to a data source 116 as an input B of the comparator 114.

The comparator 114 compares the inputs A and B. and generates an output "1" if A$\geqq$B. When the count value of the counter 28A is "0" as described above, the comparator 114 generates an output "0". For this reason, a selector 118 selects data indicating numerical value "0" (data of all "0" bits) from a data source 120, and supplies the selected data to the start address memory 28B. At this time, in the memory 28B, the memory area corresponding to the channel number "0" is selected in accordance with the channel number data CH.

When the write instruction pulse $WI_S$ is generated in response to the first input tone, start address data indicating "0" is written in a memory area corresponding to the channel number "0" of the memory 28 in accordance with this pulse. The start address data is read out from the memory 28B when the write instruction pulse $WI_S$ is disabled, and is supplied to a selector 122 as an input A.

In the write mode, the selector 122 selects the input A in accordance with the memory selection signal RA/$\overline{RO}$="1". Therefore, the start address data read out from the memory 28B is supplied to the adder 46 shown in FIG. 1 as the upper address data UAD through the selector 122.

When decay of the first input tone is ended and the counter 16A shown in FIG. 2 stops counting, the write lower address data WAD indicating the count value at this time is supplied to the end address memory 28C. At this time, in the memory 28C, a memory area corresponding to the channel number "0" is selected in accordance with the channel number data CH. When the write instruction pulse $WI_E$ is generated in synchronism with the count stop of the counter 16A, the lower address data WAD representing the count value when the counter 16A is stopped is written as end address data in a memory area corresponding to the channel number "0" of the memory 28C in accordance with this pulse. The same lower address data WAD (end address data) as that written in the memory 28C is latched by a latch 124 in accordance with the write instruction pulse $WI_E$.

Thereafter, when the step signal SS is generated, the count value of the counter 28A becomes "1", and a memory area corresponding to the channel number "1" is selected in each of the memories 28B and 28C accordingly. When the count value of the counter 28A becomes "1", the output from the comparator 114 also becomes "1", and the selector 118 thus selects the output from an adder 126, and supplies the selected output to the memory 28B.

The adder 126 adds the end address data from the latch 124 and the numerical value "1" from a data source 128, and a start address value that is larger than the end address value by one can be calculated by this addition.

When the write instruction pulse $WI_S$ is generated in response to the second input tone, the output data from the adder 126 is written as start address data in a memory area corresponding to the channel number "1" of the memory 28B in accordance with this pulse.

Thereafter, address data for a maximum of 12 channels can be written in the memories 28B and 28C with the same operation as above.

Note that the address data written in the memories 28B and 28C can be erased when the erase switch 65 is turned on so as to set the erase instruction signal $\overline{ER}$ at logic level "0".

The read mode will be described hereinafter.

In this case, the selector 110 selects the clock signal $\phi$ in accordance with the write/read control signal $W/\overline{R}$="0", and supplies the selected signal to the counter 28A. The counter 28A counts the clock signal $\phi$, whereby its count value changes like 0, 1, 2, . . . , 11, 0, 1, . . . . Data are read out from the memories 28B, 28C, 28D, and 28E in accordance with the channel number data CH corresponding to the count values.

The start address data read out from the start address memories 28B and 28D are supplied to the selector 122 as the inputs A and B, respectively, and the end address data read out from the end address memories 28C and 28E are supplied to a selector 130 as inputs A and B.

The selection operations of the selectors 122 and 130 are controlled in accordance with the memory selection signal $RA/\overline{RO}$. When the first waveshape memory 10 is used, both the selectors 122 and 130 select their inputs A in accordance with $RA/\overline{RO}$="1". As the upper address data UAD, the readout data from the memory 28B is supplied, and as the end address data EAD, the readout data from the memory 28C is delivered. When the second waveshape memory 12 is used, both the selectors 122 and 130 select their inputs B in accordance with the $RA/\overline{RO}$="0". For this reason, as the upper address data UAD, the readout data from the memory 28D is delivered, and as the end address data EAD, the readout data from the memory 28E is delivered.

Figure 4:
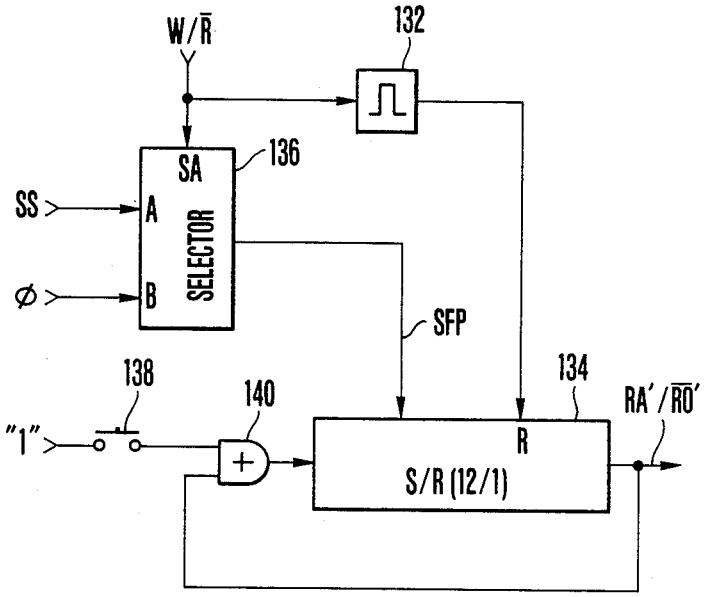
FIG. 4 is a circuit diagram showing a modification of a memory selection controller.

Modification of Memory Selection Controller (FIG. 4)

FIG. 4 shows the modified version of the memory selection controller. A memory selection signal $RA'/\overline{RO}'$ output from the controller is used instead of the memory selection signal $RA/\overline{RO}$ in the circuit shown in FIG. 1.

When the write/read control signal $W/\overline{R}$ goes to logic level "1" (the write mode is set), a rise differentiator 132 generates an output pulse to reset a 12-stage/1-bit shift register (S/R) 134, and a selector 136 selects one of its inputs. In this state, when a RAM designating switch 138 is turned on, a signal "1" is input to the shift register 134 through an OR gate 140. As a result, waveshape data stored in the memory area $M_1$ of the first wave shape memory (RAM) 10 can be used as a rhythm tone generator for the 0th channel. If the switch 138 is not turned on, waveshape data in a memory area corresponding to the channel number "0" of the second waveshape memory (ROM) 12 can be used as a rhythm tone generator for the 0th channel.

When the step switch 66 shown in FIG. 1 is turned on once to generate the step signal SS, the signal SS is supplied to the shift register 134 as a shift pulse SFP through the selector 136, and the shift register 134 performs a shift operation for one stage in response to this. In this state, a rhythm tone generator for the first channel can be selected (i.e., RAM or ROM can be selected in accordance with "1" or "0") in the same manner as described above.

Memory selection of "1" (RAM) or "0" (ROM) is allowed for each channel of the channel numbers "0" to "11". For example, "1" can be selected for the 0th to third channels, and "0" can be selected for the fourth to 11th channels. In this case, since waveshape data stored in the second waveshape memory 12 is used as the rhythm tone generator for the fourth to 11th channels, write access of waveshape data for the fourth tone and thereafter into the first waveshape memory 10 can be omitted. Thus, an input operation can be facilitated as compared to a case wherein waveshape data for 12 tones are written.

In the read mode, the selector 136 selects the clock pulse $\phi$ in accordance with the write/read control signal $W/\overline{R}$="0", and supplies the selected signal to the shift register 134 as the shift pulse SFP. For this reason, signals "1" or "0" for 12 channels are sequentially read out from the shift register 134, and are input again back to the shift register 134 through the OR gate 140. As a result, the memory selection signal $RA'/\overline{RO}'$ of a time-divisional multiple format, which represents "1" or "0" for each channel, is repetitively output from the shift register 134.

In the read mode, when the memory selection signal $RA'/\overline{RO}'$ is used instead of the memory selection signal $RA/\overline{RO}$ in the circuit shown in FIG. 1, the RAM group including the memories 28B, 28C, and 10 and the RAM group including the memories 28D, 28E, and 12 can be time-divisionally switched. Therefore, the auto-rhythm performance using both the rhythm tone generators of the first and second waveshape memories 10 and 12 can be achieved. When the storage contents of the shift register 134 and the memory 10 are appropriately changed, various rhythm performance modes can be enjoyed.

Figure 5:
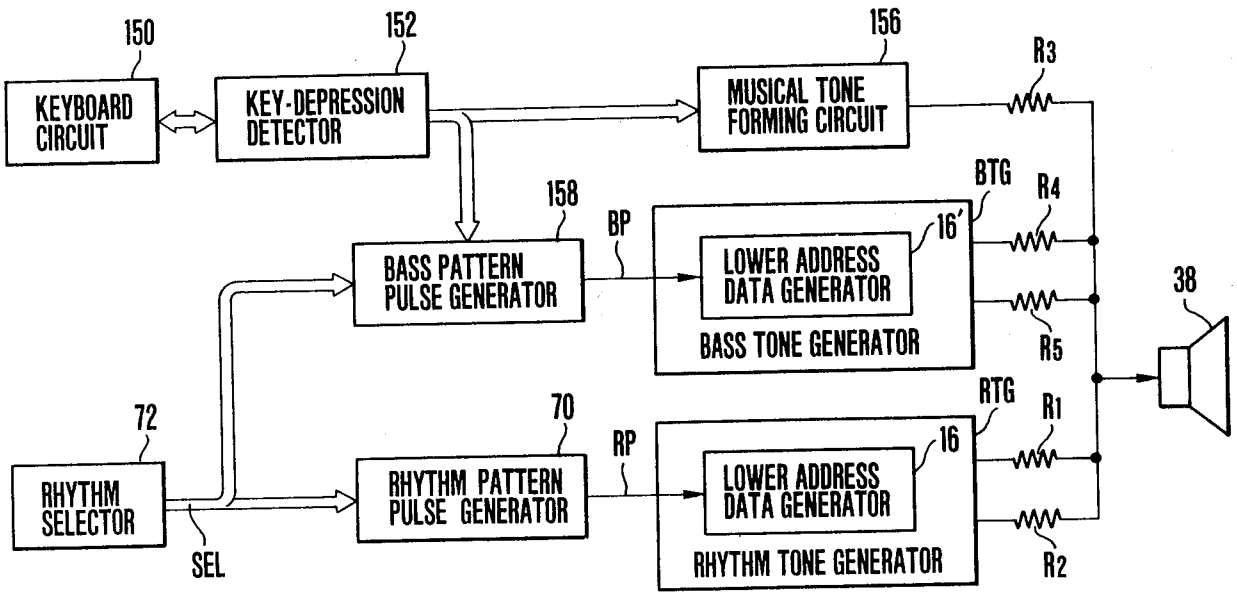
FIG. 5 is a block diagram showing a circuit arrangement of an electronic musical instrument comprising an automatic accompaniment apparatus according to another embodiment of the present invention.

Another Embodiment (FIG. 5)

FIG. 5 shows the circuit arrangement of an electronic musical instrument comprising an automatic accompaniment apparatus according to another embodiment of the present invention. The same reference numerals in FIG. 5 denote the same parts as in FIG. 1. The characteristic feature of this embodiment is that the present invention is applied to auto-bass tone generation.

A keyboard circuit 150 includes one or a plurality of stages of keyboards each having a first key area for a melody performance and a second key area for an accompaniment performance. A key-depression detector 152 detects key-operation data from the keyboard circuit 150.

The key-operation data detected from the first and second key areas are supplied to a musical tone forming circuit 156. The musical tone forming circuit 156 forms musical tone signals such as a melody tone signal, a chord tone signal, and the like based on the input key-operation data, and supplies the signals to a loudspeaker 38 through a resistor $R_3$. Therefore, musical tones corresponding to keys depressed in the first and/or second key areas are generated from the loudspeaker 38.

The key-operation data detected from the second key area is supplied to a bass pattern pulse generator 158. The generator 158 also receives rhythm selection data SEL from a rhythm selector 72.

The bass pattern pulse generator 158 includes a chord name detector, a bass pattern memory, a pitch determination circuit, and the like.

The chord name detector detects a chord name (root and chord type) based on the supplied key-operation data. The base pattern memory stores bass patterns corresponding to chord types, such as major, minor, seventh, and the like for each rhythm pattern. Each bass pattern includes interval data representing an interval with respect to the root of a bass tone to be generated at each tone generation timing. Interval data of a bass pattern corresponding to the selected rhythm type and the detected chord type is read out from the bass pattern memory. The pitch determination circuit determines a pitch of a bass tone to be generated based on the detected root and the readout interval data, and assigns a bass pattern pulse BP in a time slot corresponding to the determined pitch and outputs it.

A bass tone generator BTG has the same arrangement as that of the rhythm tone generator RTG as described above, and can receive 12 arbitrary tones. An input tone signal is supplied to the loudspeaker 38 through a resistor $R_4$ and is converted to an acoustic sound.

The bass pattern pulse BP is supplied to a lower address data generator 16' having the same arrangement as that of the lower address generator 16 described above instead of the rhythm pattern pulse RP. Waveshape data for 12 tones can be sequentially written in a first waveshape memory (corresponding to the memory 10 in FIG. 1) comprising a RAM in the bass tone generator BTG. For example, waveshape data corresponding to bass tones of $G_2$, $G\#_2$, $A_2$, $A\#_2$, and $B_2$, bass guitar tones of $C_3$, $C\#_3$, $D_3$, $D\#_3$, and $E_3$, and guitar tones of $F_3$ and $F\#_3$ can be sequentially written in the first waveshape memory. In this case, if the bass pattern pulse BP is assigned to a time slot corresponding to the 11th channel, a guitar tone signal of $F\#_3$ is sent out from the bass tone generator BTG. The guitar tone signal is supplied to the loudspeaker 38 through a resistor $R_5$, and is converted to an acoustic sound.

According to the embodiment shown in FIG. 5, the bass tone generator group used for an auto-bass performance can be desirably set, and various bass performance modes can be enjoyed.

In the above embodiment, factory-set patterns are used as accompaniment patterns such as rhythm patterns, bass patterns, and the like. However, the accompaniment patterns can be set (programmed) by a user.

The present invention can also be applied to auto-arpeggio generation and the like.

According to the present invention as described above, a plurality of arbitrary tones are input, corresponding waveshape data are written in a waveshape memory such as a RAM, and waveshape data for a plurality of tones are selectively read out from the waveshape memory in accordance with an accompaniment pattern. Therefore, various automatic performance modes can be enjoyed by changing input tones or changing an accompaniment pattern.

Since waveshape data for a plurality of tones are written in the waveshape memory, the memory space of the waveshape memory can be effectively used, and the memory capacity can be decreased.

What is claimed is:

1. An automatic accompaniment apparatus, comprising:

accompaniment pattern generation means for generating a plurality of accompaniment patterns which represent timing of generation of a plurality of accompaniment tones to be generated respectively, said accompaniment patterns corresponding to said accompaniment tones;

tone input means for inputting said accompaniment tones to be generated and for changing said accompaniment tones into a plurality of tone data respectively;

first memory means;

second memory means having a plurality of storage locations corresponding to said accompaniment patterns respectively;

writing means for writing sequentially said tone data in said first memory means and for writing a plurality of area information identifying respectively storage areas of said first memory means in which said tone data are stored, into corresponding ones of said storage locations; and reading out means for reading out said area information from said storage locations corresponding to said accompaniment patterns and for reading out said tone data from said storage area identified by said area information read out whereby accompaniment tones can be produced in accordance with said tone data read out.

2. An apparatus according to claim 1, further comprising clock pulse generating means for generating clock pulse having a predetermined frequency, and wherein said writing means has a write address counter for counting said clock pulses, said tone data being written into said storage areas designated by the count value of said write address counter.

3. An apparatus according to claim 1, further comprising:

third memory means for storing in advance preset tone data representing predetermined accompaniment tones corresponding to said accompaniment patterns respectively; and selecting means for selecting either one of said first and second memory means, and wherein said reading out means sequentially reads out said preset tone data from said third memory means instead of said first memory means when said selecting means selects said third memory means.

4. An apparatus according to claim 3, wherein said selecting means has shift register means consisting of a plurality of bits, for storing data for designating which data stored in said first and third memory means is to be read out, and said reading out means reads out tone data from said first or third memory means in accordance with the order of data stored in said shift register means.

5. An apparatus according to claim 1, wherein said accompaniment pattern generation means time-divisionally generates said accompaniment patterns.

6. An apparatus according to claim 1, wherein said tone input means comprises a microphone.

7. An apparatus according to claim 1, wherein said area information comprises start addresses representing head addresses of said storage areas.

* * * * *

UNITED STATES PATENT AND TRADEMARK OFFICE

CERTIFICATE OF CORRECTION

PATENT NO. : 4,785,703

DATED : 11-22-88

INVENTOR(S) : Ichiki

It is certified that error appears in the above-identified patent and that said Letters Patent is hereby corrected as shown below:

| Column | Line | Correction |
|---|---|---|
| 7 | 48 | delete "(m", insert --(m-- |

Signed and Sealed this

Twenty-sixth Day of September, 1989

*Attest:*

DONALD J. QUIGG

*Attesting Officer*

*Commissioner of Patents and Trademarks*